US012369728B2

(12) United States Patent
Cammarata

(10) Patent No.: US 12,369,728 B2
(45) Date of Patent: Jul. 29, 2025

(54) BABY CARRIER ASSEMBLY

(71) Applicant: Naomi Cammarata, Norwell, MA (US)

(72) Inventor: Naomi Cammarata, Norwell, MA (US)

( * ) Notice: Subject to any disclaimer, the term of this patent is extended or adjusted under 35 U.S.C. 154(b) by 173 days.

(21) Appl. No.: 18/386,541

(22) Filed: Nov. 2, 2023

(65) Prior Publication Data

US 2025/0143482 A1 May 8, 2025

(51) Int. Cl.
*A47D 13/02* (2006.01)

(52) U.S. Cl.
CPC ..... *A47D 13/02* (2013.01); *A47D 13/025* (2013.01)

(58) Field of Classification Search
CPC ..... A47D 13/02; A47D 13/025
USPC ..... 224/159, 160; D3/213
See application file for complete search history.

(56) References Cited

U.S. PATENT DOCUMENTS 5,492,256 A * 2/1996 Ive ..... A47D 13/025 224/159
5,641,101 A * 6/1997 Nakayama ..... A47D 13/025 224/159
5,657,912 A * 8/1997 Nakayama ..... A45F 3/00 224/159
5,711,466 A * 1/1998 Kataoka ..... A47D 13/029 224/159
D393,363 S * 4/1998 Kataoka ..... D3/215
5,934,528 A * 8/1999 Higuchi ..... A47D 13/025 224/159
6,325,259 B1 * 12/2001 Tharalson ..... A47D 13/029 224/159
D738,614 S 9/2015 Chapman
9,700,152 B2 * 7/2017 Telford ..... A47D 13/025
10,271,664 B2 * 4/2019 Yan ..... A47D 13/025
10,786,092 B1 * 9/2020 Yan ..... A47D 13/025
11,191,368 B2 12/2021 Manouchehri
D976,012 S * 1/2023 Tsai ..... D6/333
D1,041,874 S * 9/2024 Ge ..... D3/214
2005/0077330 A1 4/2005 Fernandez
2014/0231472 A1 * 8/2014 Cha ..... A47D 13/025 224/159
2022/0087444 A1 3/2022 Farrell
2022/0304479 A1 9/2022 Yetinson
2022/0304480 A1 9/2022 Fosse
2024/0099478 A1 * 3/2024 Xie ..... A47D 13/025
2025/0098872 A1 * 3/2025 Hu ..... A47D 13/02
(Continued)

FOREIGN PATENT DOCUMENTS

CN 109310218 B * 11/2021 ..... A47D 13/025
DE 102016115399 B4 * 6/2019 ..... A47D 13/025
GB 2626716 A * 8/2024 ..... A47D 13/025
(Continued)

*Primary Examiner* — Justin M Larson

(57) ABSTRACT

A baby carrier assembly includes a belt that can be worn about a mother's waist. A sleeve is positioned around the belt and the sleeve defines a cushion chamber that is centrally located on the belt. A cushion is positioned within the cushion chamber to facilitate a baby to be seated on the cushion chamber when the belt is worn around the mother's waist. A first scarf is extendable through the cushion chamber in the sleeve such that the first scarf forms a pair of arms that can be wrapped around the baby and the mother's torso thereby securing the baby to the mother's torso. A second scarf is provided which is wrappable around the first scarf to facilitate the baby to be firmly secured against the mother's torso.

9 Claims, 10 Drawing Sheets

(56) References Cited

U.S. PATENT DOCUMENTS

| | | | | | |
|---|---|---|---|---|---|
| 2025/0143482 | A1* | | 5/2025 | Cammarata | A47D 13/029 |

FOREIGN PATENT DOCUMENTS

| | | | | | |
|---|---|---|---|---|---|
| KR | 101125694 | B1 | * | 3/2012 | A47D 15/00 |
| KR | 20200053179 | A | * | 5/2020 | A47D 13/025 |
| KR | 102612662 | B1 | * | 12/2023 | A47D 13/02 |
| KR | 200498171 | Y1 | * | 7/2024 | A47D 15/00 |
| KR | 20240163721 | A | * | 11/2024 | A47D 13/025 |
| KR | 20240174896 | A | * | 12/2024 | A47D 15/005 |
| MY | 171253 | A | * | 10/2019 | A47D 13/025 |
| WO | WO2020102152 | | | 5/2020 | |

* cited by examiner

BABY CARRIER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION

(1) Field of the Invention.

The disclosure relates to baby carrier devices and more particularly pertains to a new baby carrier device for facilitating a mother to carry a baby in a hands-free manner. The device includes a belt that is wearable around a mother's waist and a sleeve through which the belt extends and a cushion integrated into the sleeve upon which a baby can sit when the belt is worn around the mother's waist. The device includes a scarf that is wrapped around the cushion and which is subsequently wrapped around the mother and the baby to secure the baby to the mother.

(2) Description of Related Art Including Information Disclosed Under 37 CFR 1.97 and 1.98.

The prior art relates to baby carrier devices including a variety of baby sling devices that can be wrapped around a mother for securing a baby to the mother and a variety of baby carriers that each at least includes a waist belt and a plurality of straps for securing a baby to a mother. In no instance does the prior art disclose a baby carrier device that includes a waist belt, a sleeve through which the waist belt extends, a cushion integrated into the sleeve upon which a baby can be seated and a scarf that can be wrapped around the cushion and subsequently wrapped around the baby and the mother for securing the baby to the mother.

BRIEF SUMMARY OF THE INVENTION

An embodiment of the disclosure meets the needs presented above by generally comprising a belt is configured for wearing about a mother's waist. A sleeve is positioned around the belt and the sleeve defines a cushion chamber that is centrally located on the belt. A cushion is positioned within the cushion chamber to facilitate a baby to be seated on the cushion chamber when the belt is worn around the mother's waist. A first scarf is extendable through the cushion chamber in the sleeve such that the first scarf forms a pair of arms that can be wrapped around the baby and the mother's torso thereby securing the baby to the mother's torso. A second scarf is provided which is wrappable around the first scarf to facilitate the baby to be firmly secured against the mother's torso.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
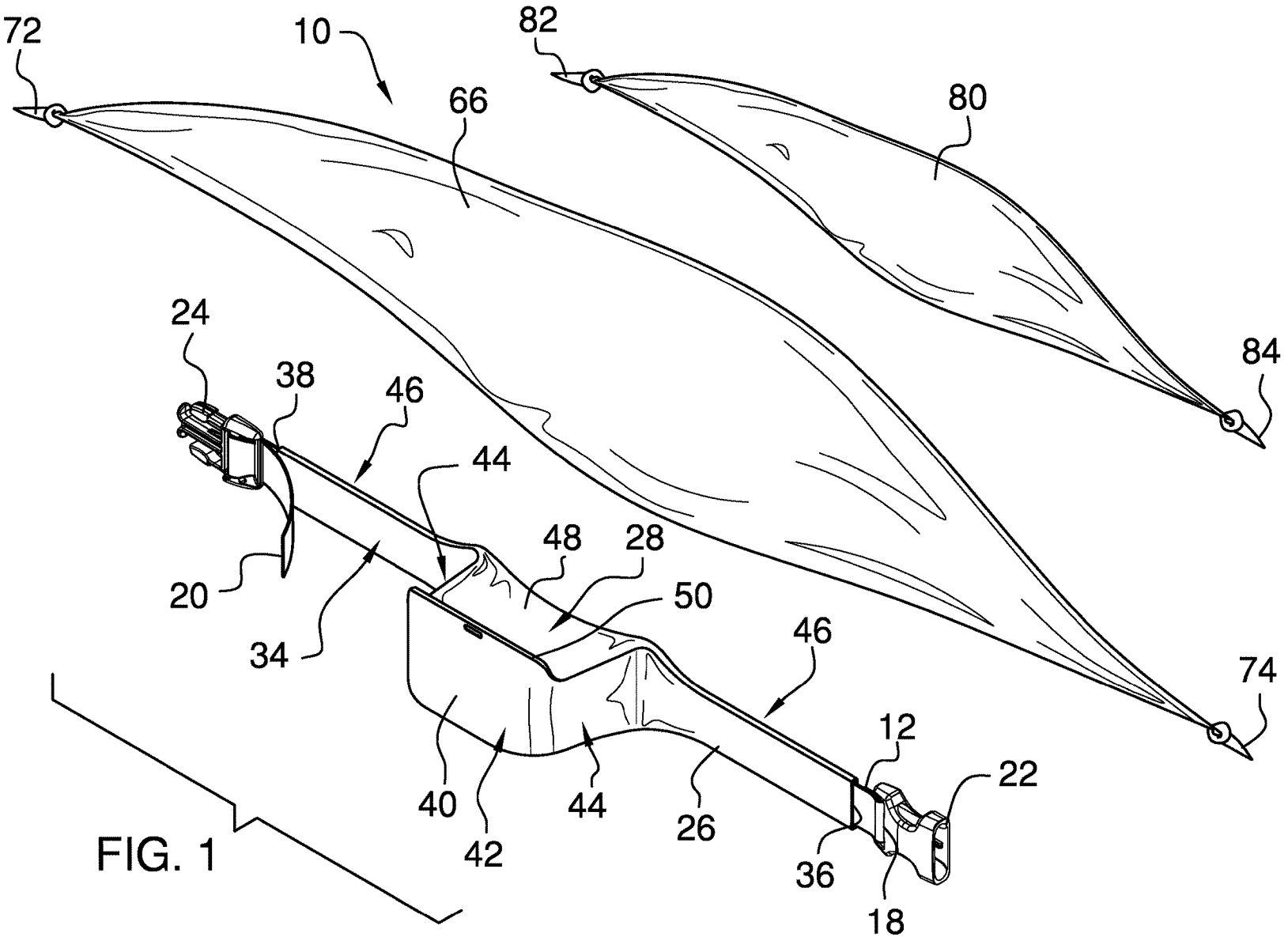
FIG. 1 is a perspective view of a baby carrier assembly according to an embodiment of the disclosure.
Figure 2:
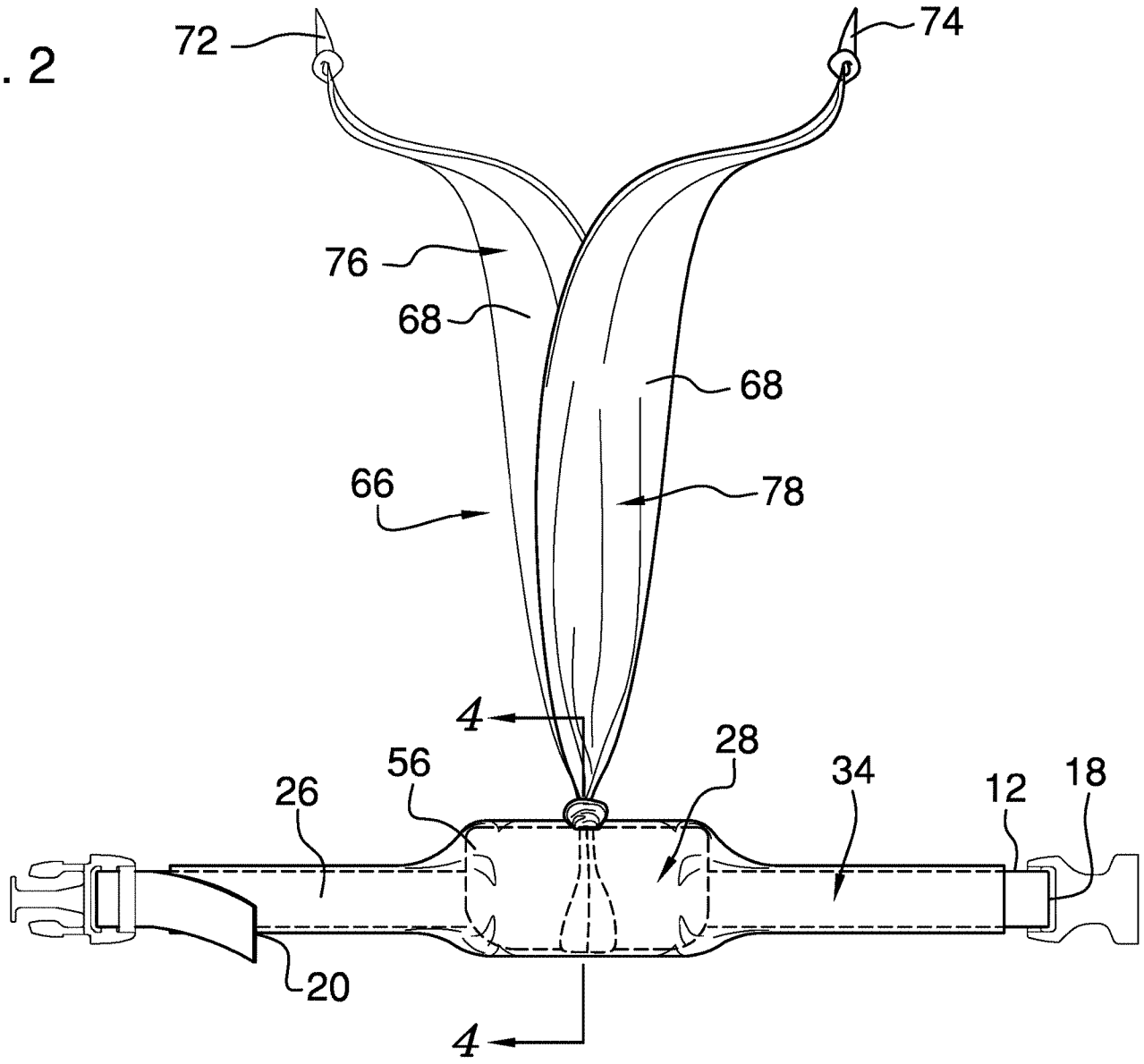
FIG. 2 is a front phantom view of an embodiment of the disclosure.
Figure 3:
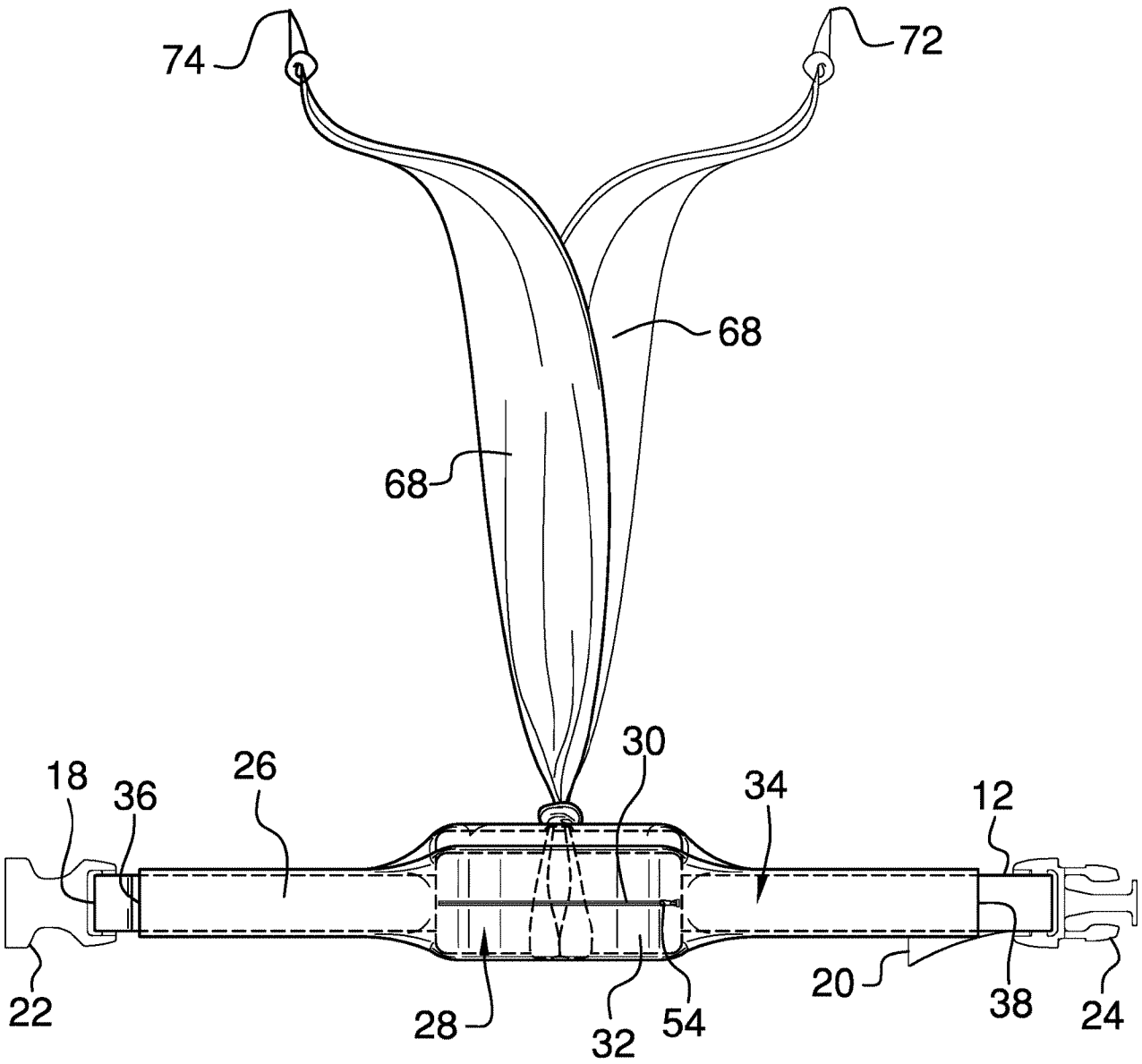
FIG. 3 is a back phantom view of an embodiment of the disclosure.
Figure 4:
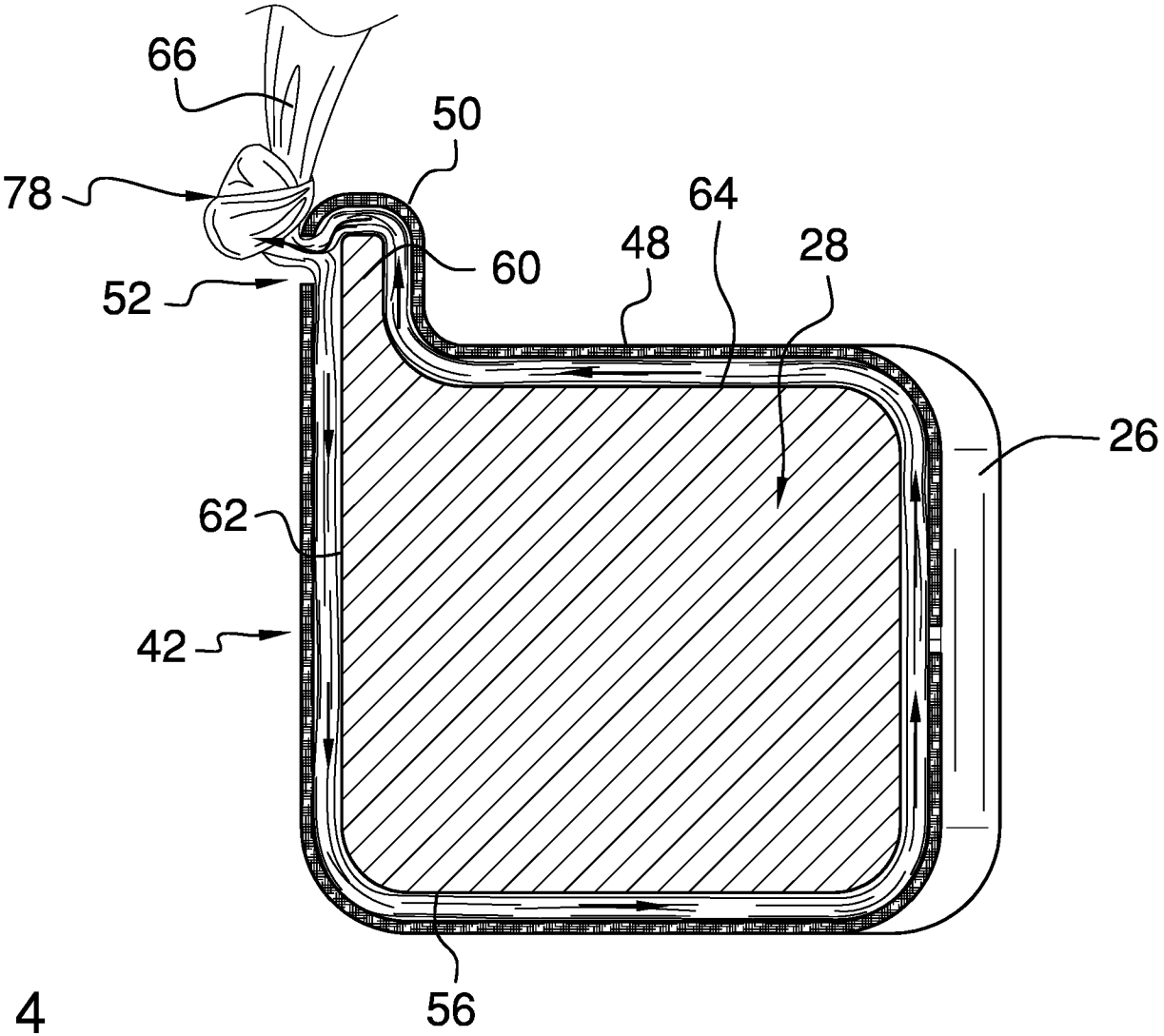
FIG. 4 is a cross sectional view taken along line 4-4 of FIG. 3 of an embodiment of the disclosure.

With reference now to the drawings, and in particular to FIGS. 1 through 10 thereof, a new carrier device embodying the principles and concepts of an embodiment of the disclosure and generally designated by the reference numeral 10 will be described.

As best illustrated in FIGS. 1 through 10, the baby carrier assembly 10 generally comprises a belt 12 that can be worn about a waist 14 of a mother 16. The belt 12 has a first end 18 and a second end 20 and the first end 18 is looped through a first buckle 22 having the first end 18 being attached to the belt 12 for securing the belt 12 to the first buckle 22. The second end 20 is looped through a second buckle 24 having the second end 20 being free thereby facilitating the belt 12 to be pulled through the second buckle 24 for adjusting a length of the belt 12 between the first buckle 22 and the second buckle 24. Furthermore, the first buckle 22 is matable to the second buckle 24 thereby forming the belt 12 into a closed loop of an adjustable diameter.

A sleeve 26 is positioned around the belt 12 such that the sleeve 26 extends around the mother's waist 14 when the belt 12 is being worn and the sleeve 26 defines a cushion chamber 28 that is centrally located on the belt 12. The sleeve 26 has a slot 30 extending through a back side 32 of an outer wall 34 of the sleeve 26 and into the cushion chamber 28; the slot 30 is centrally positioned between a primary end 36 and a secondary end 38 of the sleeve 26. A front side 40 of the outer wall 34 has a central portion 42 extending between a pair of sidelong portions 44 which are each perpendicularly oriented with a respective one of a pair of flattened portions 46. Additionally, each of the pair of flattened portions 46 is associated with a respective one of the primary end 36 and the secondary end 38 of the sleeve 26. The central portion 42 is perpendicularly oriented with the pair of sidelong portions 44 such that the central portion 42 lies on a plane that is oriented parallel to the pair of flattened portions 46. In this way the cushion chamber 28 is defined between the central portion 42 and the back side 32 of the outer wall 34 having the cushion chamber 28 being bounded by the pair of sidelong portions 44.

The central portion 42 extends upwardly beyond a top side 48 of the outer wall 34 which extends between the back side 32 of the outer wall 34 and the central portion 42. In this way the central portion 42 defines a lip 50 which extends upwardly from the top side 48 and which extends along a full length of the central portion 42. The central portion 42 has a hole 52 extending into the cushion chamber 28 and the hole 52 is centrally located along the lip 50. The belt 12 extends through each of the pair of flattened portions 46 such that the first buckle 22 is spaced from the primary end 36 and the second buckle 24 is spaced from the secondary end 38. A closure 54 is integrated into the back side 32 of the outer wall 34 of the sleeve 26 and the closure 54 is oriented to extend along the slot 30. The closure 54 opens or closes the slot 30 when the closure 54 is manipulated between an open condition or a closed condition. Additionally, the closure 54 may comprise a zipper or other type of releasable, mechanical closure.

A cushion 56 is positioned within the cushion chamber 28 to facilitate a baby 58 to be seated on the cushion chamber 28 when the belt 12 is worn around the mother's waist 14. In this way the belt 12 and the cushion 56 transfer the weight of the baby 58 into the mother's waist 14. The cushion 56 has a prominence 60 which extends upwardly from an intersection between a front surface 62 of the cushion 56 and a top surface 64 of the cushion 56 and the prominence 60 extends into the lip 50 defined on the sleeve 26. The lip 50 on the sleeve 26 inhibits the baby 58 from sliding forwardly off of the cushion 56 when the baby 58 is seated on the cushion 56. The cushion 56 is removable from the cushion chamber 28 through the slot 30 in the back side 32 of the outer wall 34 of the sleeve 26 for laundering. Additionally, the cushion 56 is comprised of a resiliently compressible material, including but not being limited to polyurethane foam or neoprene, such that the cushion 56 can simultaneously support the weight of the baby 58 and enhance comfort for the baby 58.

A first scarf 66 is provided which is extendable through the cushion chamber 28 in the sleeve 26 such that the first scarf 66 forms a pair of arms 68 which each has a length of at least 60.0 cm. In this way each of the pair of arms 68 can be wrapped around the baby 58 and the mother's torso 70 thereby securing the baby 58 to the mother's torso 70. The first scarf 66 has a first end 72 and a second end 74 and the first scarf 66 is knotted adjacent to each of the first end 72 and the second end 74 of the first scarf 66. In this way the first scarf 66 tapers to a point at each of the first end 72 and the second end 74 of the first scarf 66.

The first scarf 66 is folded in half to define each of the pair of arms 68 and each of the arms 68 is looped around the cushion 56 having each of the arms 68 extending into and outwardly from the hole 52 in the lip 50 defined in the sleeve 26. Each of the arms 68 are passed through a loop 78 formed in the first scarf 66 when the first scarf is folded to define the arms 68 such that the first end 72 and the second end 74 of the first scarf 66 are aligned with each other. Each of the arms 68 defined in the first scarf 66 is associated with a respective one of the first end 72 and the second end 74 of the first scarf 66. Additionally, the pair of arms 68 are secured at a point where the pair of arms 68 exits the hole 52 in the lip 50 and passes through the loop 78 in the first scarf 66 thereby inhibiting the first scarf 66 from being removed from the cushion chamber 28.

A second scarf 80 is provided which has a length that is less than a length of the first scarf 66. The second scarf 80 is wrappable around the first scarf 66 when the first scarf 66 is wrapped around the mother's torso 70. In this way the second scarf 80 facilitates the baby 58 to be firmly secured against the mother's torso 70. The second scarf 80 has a first end 82 and a second end 84 and the second scarf 80 is knotted adjacent to each of the first end 82 and second end 84 of the second scarf 80 such that the second scarf 80 tapers to a point at each of the first end 82 and the second end 84 of the second scarf 80.

Figure 5:
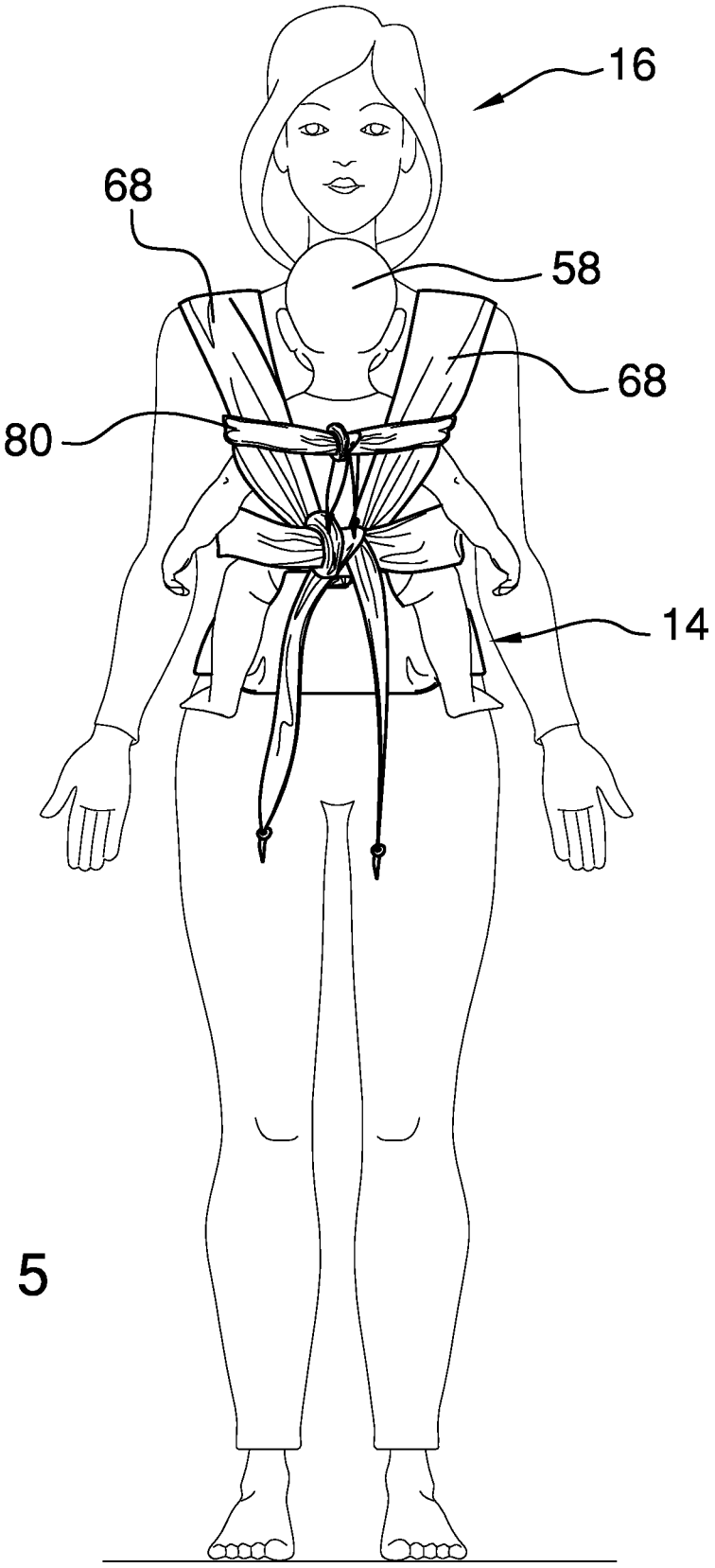
FIG. 5 is a front in-use view of an embodiment of the disclosure showing a baby facing a mother.
Figure 6:
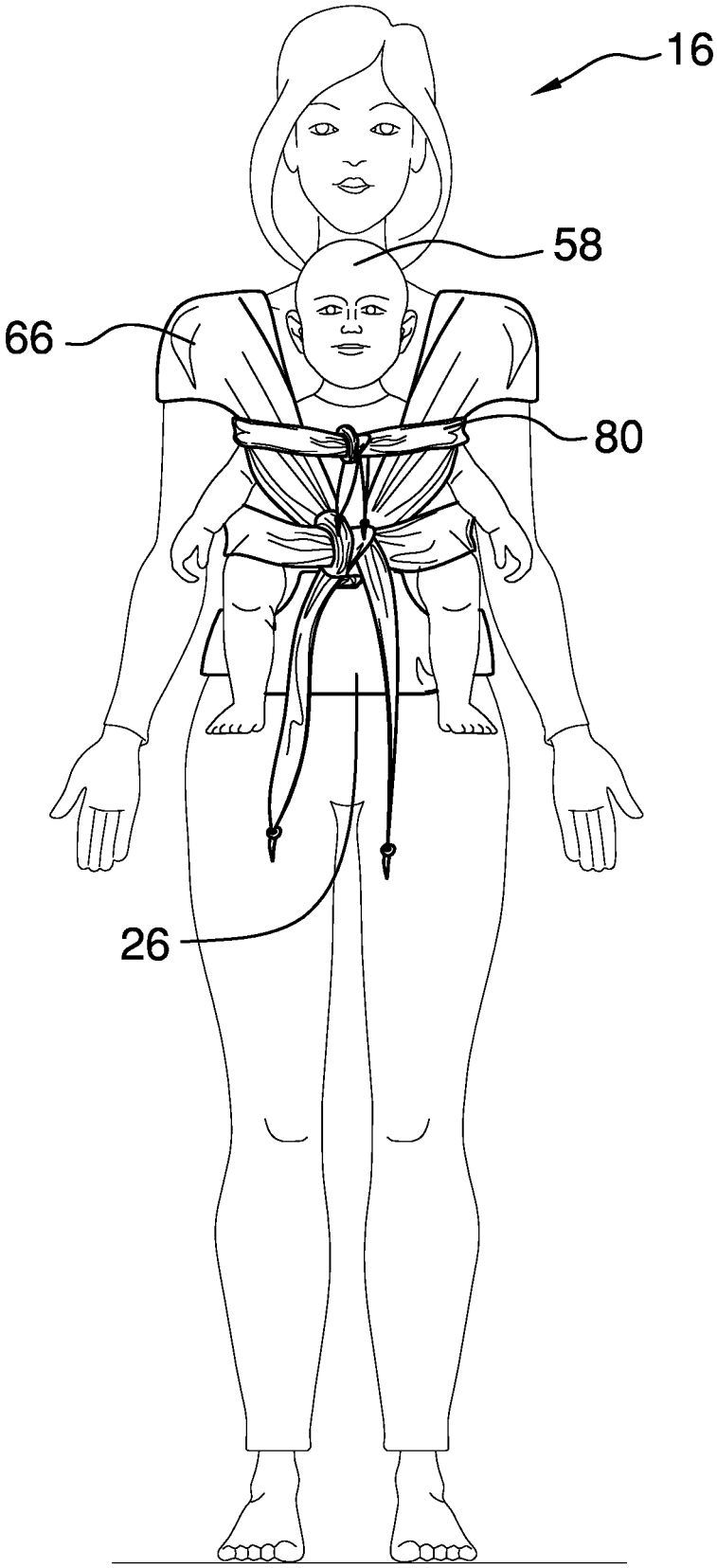
FIG. 6 is a front in-use view of an embodiment of the disclosure showing a baby facing away from a mother.
Figure 7:
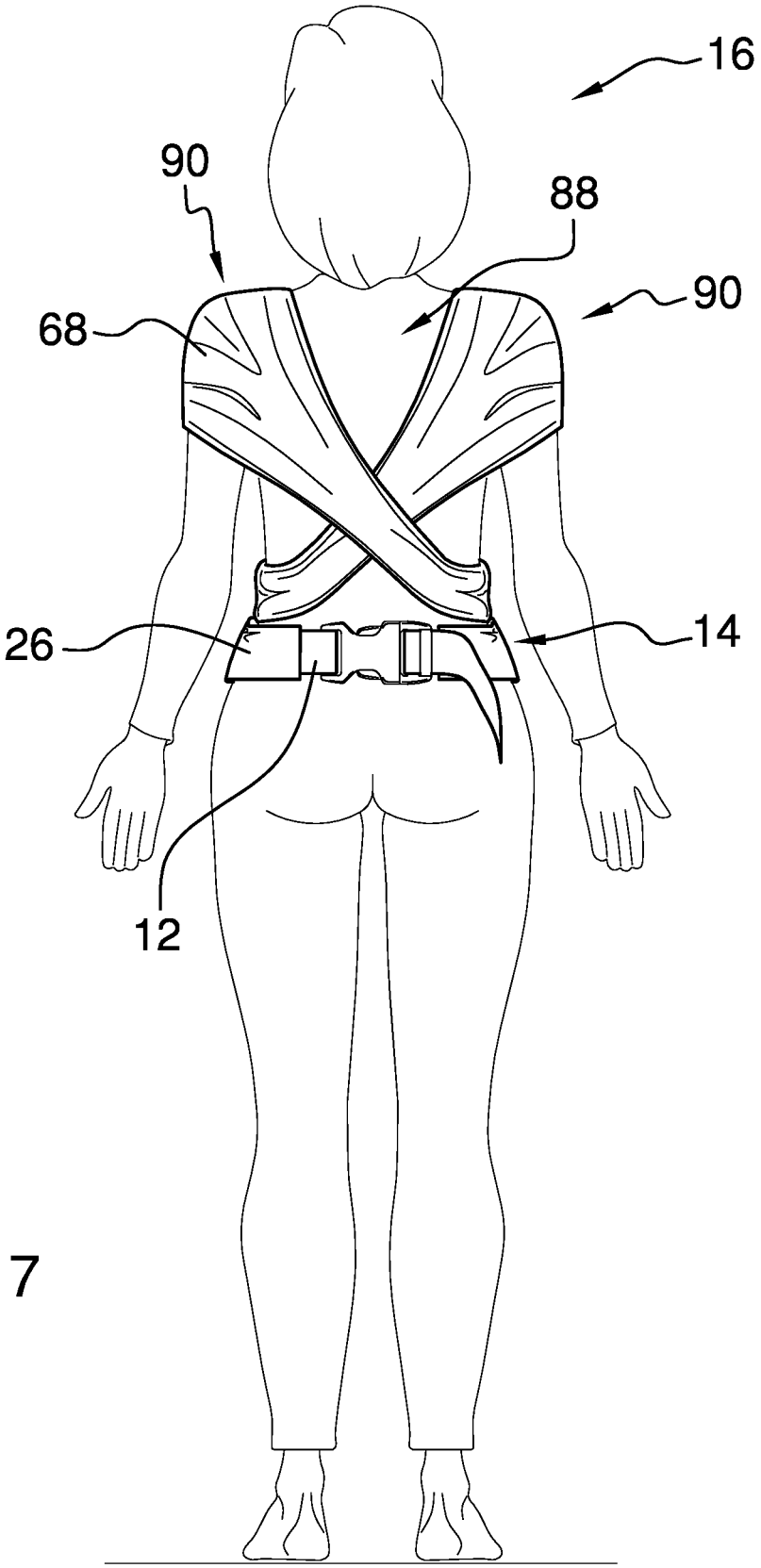
FIG. 7 is a back in-use view of an embodiment of the disclosure.
Figure 8:
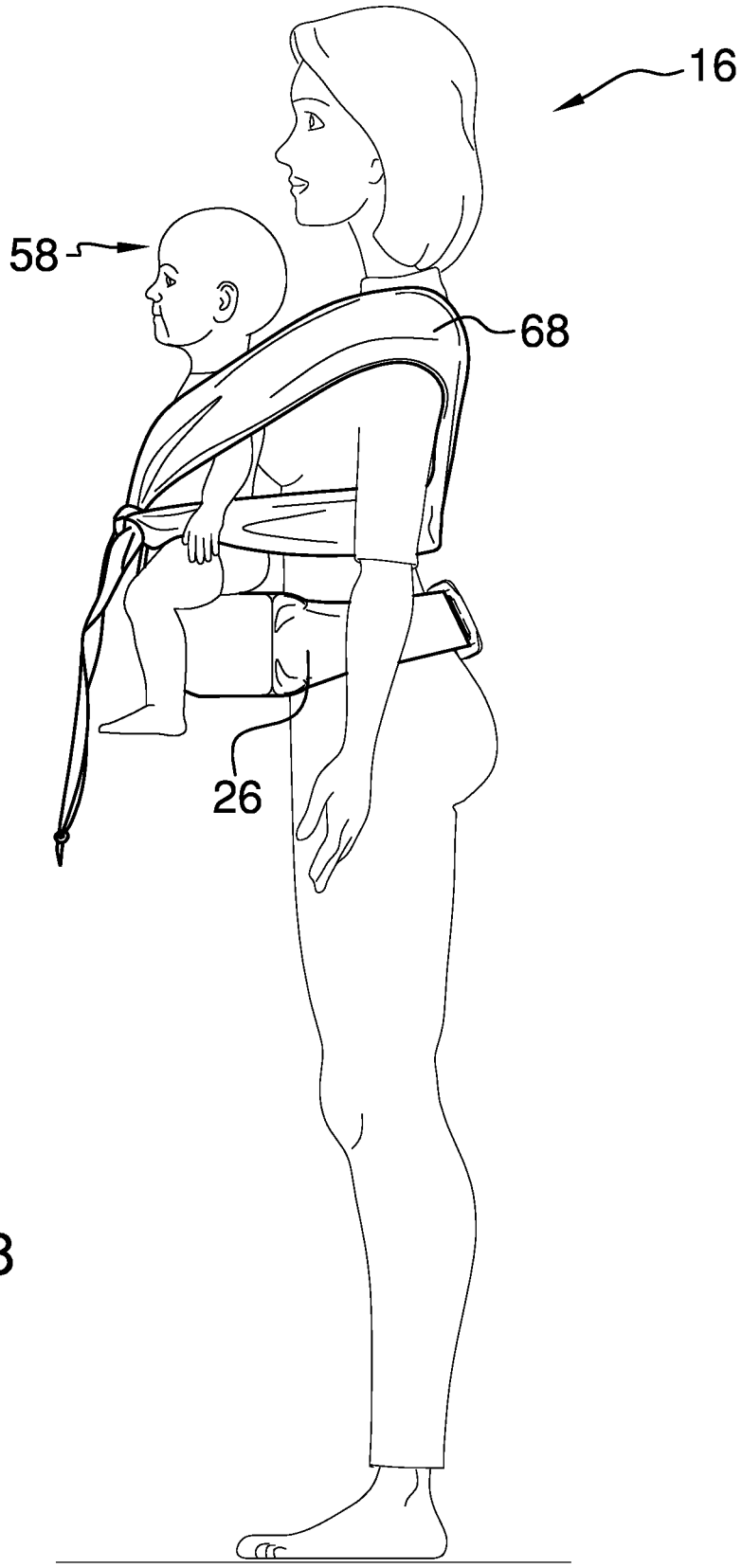
FIG. 8 is a left side in-use view of an embodiment of the disclosure.

In use, as is shown in FIGS. 5, 6 and 8, the belt 12 is worn around the mother's waist 14 such that the cushion 56 is positioned on a front side 86 of the mother's waist 14. As is shown in FIGS. 6 and 8, the baby 58 is seated on the cushion 56 having the baby 58 facing away from the mother 16. Each of the first arm 76 and the second arm 78 defined in the first scarf 66 are wrapped around the baby 58 and the mother's torso 70 and crossed along the mother's back 88 and routed over each of the mother's shoulders 90 and downwardly over the baby 58 and subsequently tied together on the front of the baby 58. In this way the baby 58 is secured to the mother's torso 70 to facilitate the mother 16 to carry the baby 58 in a hands-free manner.

Figure 9:
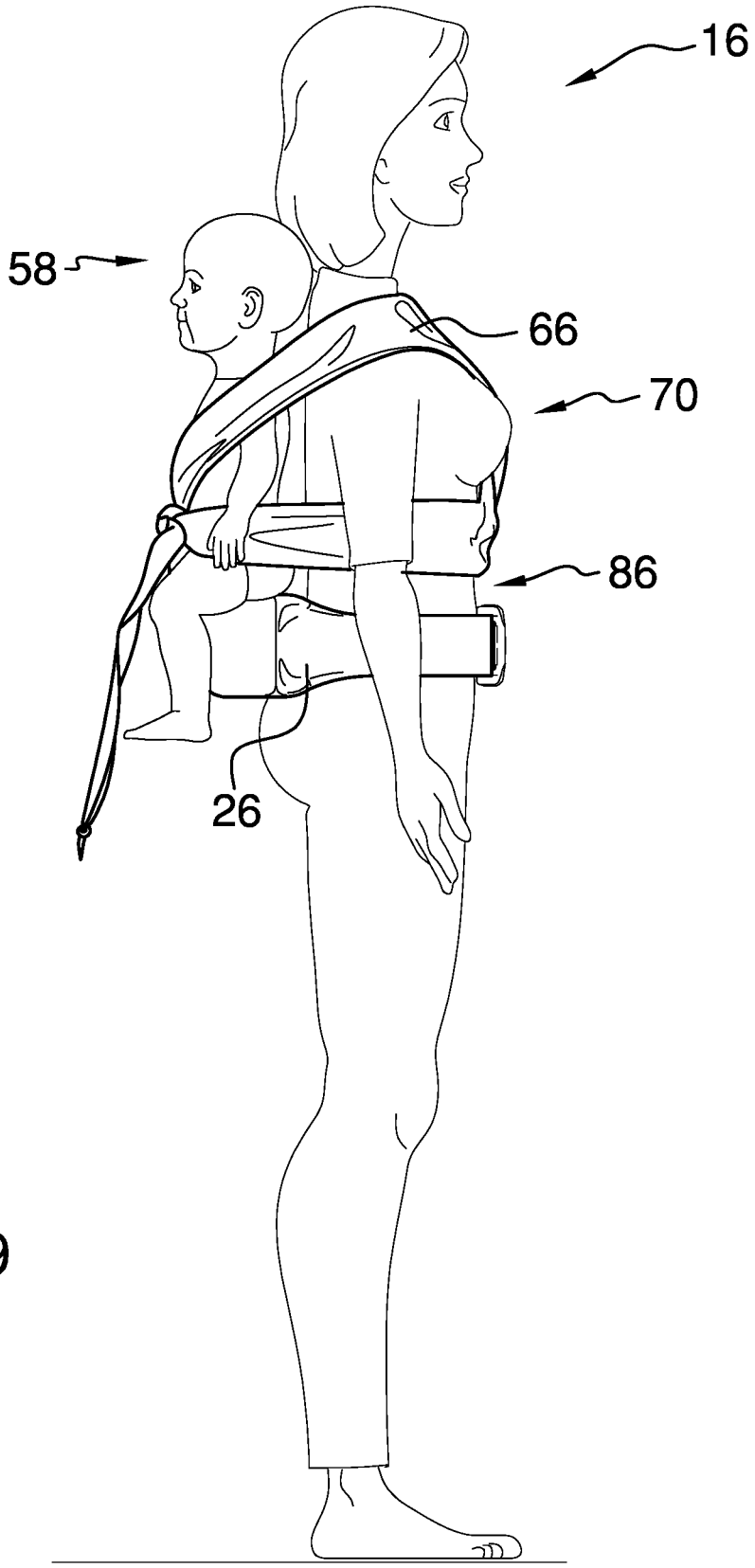
FIG. 9 is a right side in-use view of an embodiment of the disclosure.
Figure 10:
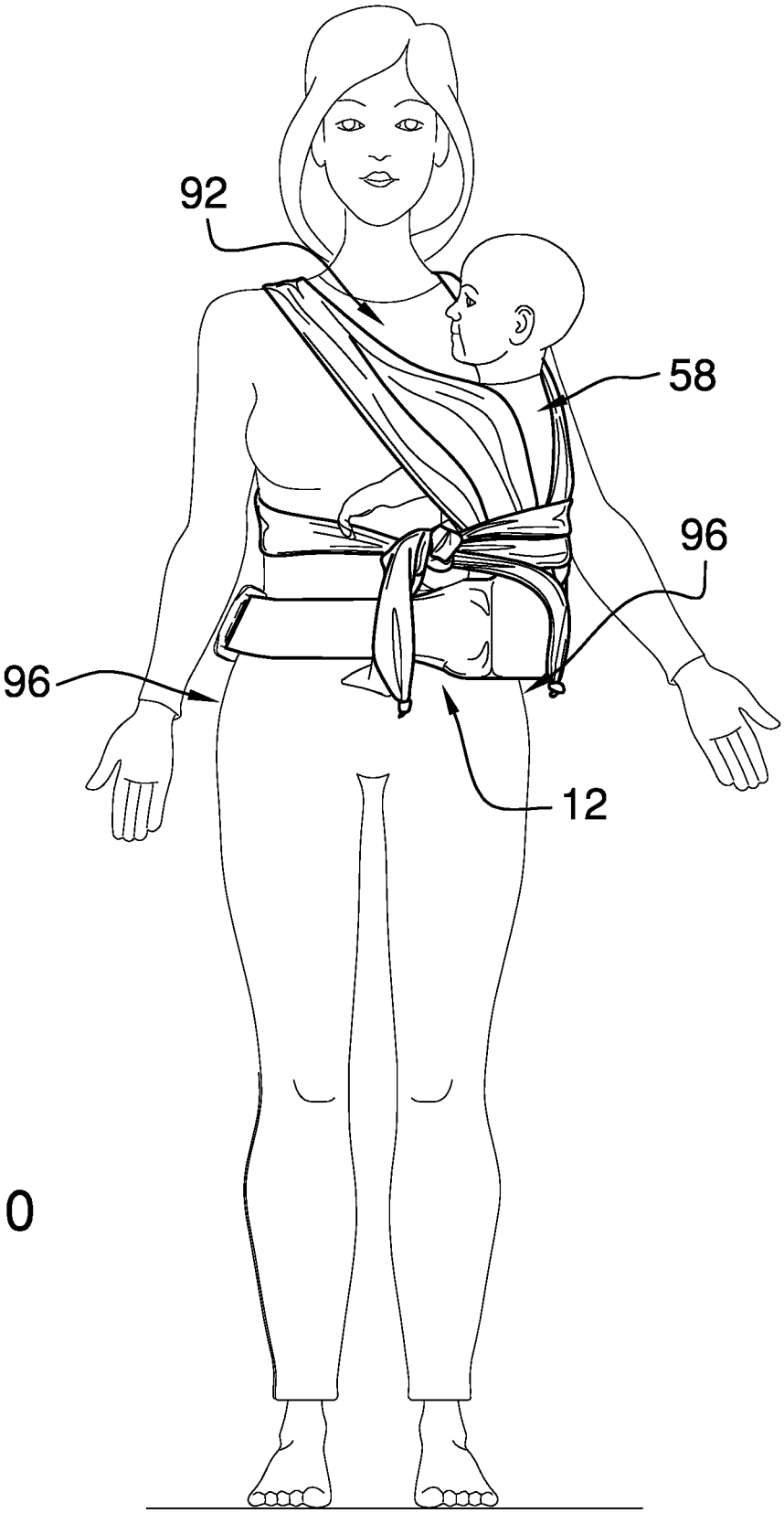
FIG. 10 is a front in-use view of an embodiment of the disclosure showing a baby being supported on a mother's hip.

As is shown in FIG. 5, the baby 58 can be positioned on the cushion having the baby 58 facing the mother 16. As is shown in FIG. 9, the belt 12 is oriented such that the cushion 56 is placed on the mother's back 88 and each of the first arm 76 and second arm 78 are wrapped around the baby 58 and crossed along the mother's chest 92 and routed over each of the mother's shoulders 90 and downwardly over the baby 58 and subsequently tied together on the front of the baby 58. In this way the baby 58 is secured to the mother's back 88. Additionally, as is shown in FIG. 6, the second scarf 80 can be tied around each of the first arm 76 and the second arm 78 such that the second scarf 80 extends across the baby's chest 94 to further secure the baby 58 to the mother 16. As is shown in FIG. 10, the belt 12 is oriented such that the cushion 56 is placed on either of the mother's hips 96 and each of the first arm 76 and the second arm 78 are wrapped around the mother's chest 92 and the mother's back 88 and are tied together against the baby 58. In this way the baby 58 is secured on either of the mother's hips 96.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A baby carrier assembly for facilitating a baby to be carried on a mother's torso in a seated position, said assembly comprising:

a belt being configured for wearing about a mother's waist;

a sleeve being positioned around said belt wherein said sleeve is configured to extend around the mother's waist when said belt is being worn, said sleeve defining a cushion chamber being centrally located on said belt;

a cushion being positioned within said cushion chamber wherein said cushion is configured to facilitate a baby to be seated on said cushion chamber when said belt is worn around the mother's waist;

a first scarf being extendable through said cushion chamber in said sleeve such that said first scarf forms a pair of arms wherein each of said pair of arms is configured to be wrapped around the baby and the mother's torso thereby securing the baby to the mother's torso; and a second scarf having a length being less than a length of said first scarf, said second scarf being wrappable around said first scarf when said first scarf is wrapped around the mother's torso wherein said second scarf is configured to facilitate the baby to be firmly secured against the mother's torso.

2. The assembly according to claim 1, wherein:

said sleeve has a slot extending through a back side of an outer wall of said sleeve, said slot is centrally positioned between a primary end and a secondary end of said sleeve;

a front side of said outer wall has a central portion extending between a pair of sidelong portions which are each perpendicularly oriented with a respective one of a pair of flattened portions;

each of said pair of flattened portions is associated with a respective one of said primary end and said secondary end of said sleeve; and said central portion is perpendicularly oriented with said pair of sidelong portions such that said central portion lies on a plane being oriented parallel to said pair of flattened portions such that said cushion chamber is defined between said central portion and said back side of said outer wall having said cushion chamber being bounded by said pair of sidelong portions.

3. The assembly according to claim 2, wherein:

said central portion extends upwardly beyond a top side of said outer wall which extends between said back side of said outer wall and said central portion to define a lip extending upwardly from said top side which extends along a full length of said central portion;

said central portion has a hole extending into said cushion chamber; and said hole is centrally located along said lip.

4. The assembly according to claim 2, wherein:

said belt has a first end and a second end;

said first end is looped through a first buckle having said first end being attached to said belt for securing said belt to said first buckle;

said second end is looped through a second buckle having said second end being free thereby facilitating said belt to be pulled through said second buckle for adjusting a length of said belt between said first buckle and said second buckle;

said first buckle is matable to said second buckle thereby forming said belt into a closed loop of an adjustable diameter; and said belt extends through each of said pair of flattened portions such that said first buckle is spaced from said primary end and said second buckle is spaced from said secondary end.

5. The assembly according to claim 3, further comprising a closure being integrated into said back side of said outer wall of said sleeve, said closure being oriented to extend along said slot, said closure opening or closing said slot when said closure is manipulated between an open condition or an closed condition.

6. The assembly according to claim 3, wherein:

said cushion has a prominence which extends upwardly from an intersection between a front surface of said cushion and a top surface of said cushion;

said prominence extends into said lip defined on said sleeve;

said cushion is removable from said cushion chamber through said slot in said back side of said outer wall of said sleeve; and said cushion is comprised of a resiliently compressible material wherein said cushion is configured to simultaneously support the weight of the baby and enhance comfort for the baby.

7. The assembly according to claim 6, wherein:

said first scarf has a first end and a second end;

said first scarf is knotted adjacent to each of said first end and said second end of said first scarf such that said first scarf tapers to a point at each of the first end and said second end of said first scarf;

said first scarf being looped around said cushion having said first scarf extending into and outwardly from said hole in said lip defined in said sleeve such that said first end and said second end of said first scarf are aligned with each other;

each of said arms defined in said first scarf is associated with a respective one of said first end and said second end of said first scarf; and said pair of arms are extended through a loop defined in said first scarf where said first scarf exits said hole in said lip thereby inhibiting said first scarf from being removed from said cushion chamber.

8. A baby carrier assembly for facilitating a baby to be carried on a mother's torso in a seated position, said assembly comprising:

a belt being configured for wearing about a mother's waist, said belt having a first end and a second end, said first end being looped through a first buckle having said first end being attached to said belt for securing said belt to said first buckle, said second end being looped through a second buckle having said second end being free thereby facilitating said belt to be pulled through said second buckle for adjusting a length of said belt between said first buckle and said second buckle, said first buckle being matable to said second buckle thereby forming said belt into a closed loop of an adjustable diameter;

a sleeve being positioned around said belt wherein said sleeve is configured to extend around the mother's waist when said belt is being worn, said sleeve defining a cushion chamber being centrally located on said belt, said sleeve having a slot extending through a back side of an outer wall of said sleeve, said slot being centrally positioned between a primary end and a secondary end of said sleeve, a front side of said outer wall having a central portion extending between a pair of sidelong portions which are each perpendicularly oriented with a respective one of a pair of flattened portions, each of said pair of flattened portions being associated with a respective one of said primary end and said secondary end of said sleeve, said central portion being perpendicularly oriented with said pair of sidelong portions such that said central portion lies on a plane being oriented parallel to said pair of flattened portions such that said cushion chamber is defined between said central portion and said back side of said outer wall having said cushion chamber being bounded by said pair of sidelong portions, said central portion extending upwardly beyond a top side of said outer wall which extends between said back side of said outer wall and said central portion to define a lip extending upwardly from said top side which extends along a full length of said central portion, said central portion having a hole extending into said cushion chamber, said hole being centrally located along said lip, said belt extending through each of said pair of flattened portions such that said first buckle is spaced from said primary end and said second buckle is spaced from said secondary end;

a closure being integrated into said back side of said outer wall of said sleeve, said closure being oriented to extend along said slot, said closure opening or closing said slot when said closure is manipulated between an open condition or a closed condition;

a cushion being positioned within said cushion chamber wherein said cushion is configured to facilitate a baby to be seated on said cushion chamber when said belt is worn around the mother's waist, said cushion having a prominence which extends upwardly from an intersection between a front surface of said cushion and a top surface of said cushion, said prominence extending into said lip defined on said sleeve, said cushion being removable from said cushion chamber through said slot in said back side of said outer wall of said sleeve, said cushion being comprised of a resiliently compressible material wherein said cushion is configured to simultaneously support the weight of the baby and enhance comfort for the baby;

a first scarf being extendable through said cushion chamber in said sleeve such that said first scarf forms a pair of arms each having a length of at least 60.0 cm wherein each of said pair of arms is configured to be wrapped around the baby and the mother's torso thereby securing the baby to the mother's torso, said first scarf having a first end and a second end, said first scarf being knotted adjacent to each of said first end and said second end of said first scarf such that said first scarf tapers to a point at each of the first end and said second end of said first scarf, said first scarf being looped around said cushion having said first scarf extending into and outwardly from said hole in said lip defined in said sleeve such that said first end and said second end of said first scarf are aligned with each other, each of said arms defined in said first scarf being associated with a respective one of said first end and said second end of said first scarf, said pair of arms being extended through a loop defined in said first scarf where said first scarf exits said hole in said lip thereby inhibiting said first scarf from being removed from said cushion chamber; and a second scarf having a length being less than a length of said first scarf, said second scarf being wrappable around said first scarf when said first scarf is wrapped around the mother's torso wherein said second scarf is configured to facilitate the baby to be firmly secured against the mother's torso, said second scarf having a first end and a second end, said second scarf being knotted adjacent to each of said first end and second end of said second scarf such that said second scarf tapers to a point at each of the first end and said second end of said second scarf.

9. The assembly according to claim 1, wherein: each of said pair of arms has a length of at least 60.0 cm.

* * * * *